US008888664B1

(12) United States Patent
Butler

(10) Patent No.: US 8,888,664 B1
(45) Date of Patent: Nov. 18, 2014

(54) EXERCISE BENCH SYSTEM

(71) Applicant: Jose R. Butler, Ocoee, FL (US)

(72) Inventor: Jose R. Butler, Ocoee, FL (US)

( * ) Notice: Subject to any disclaimer, the term of this patent is extended or adjusted under 35 U.S.C. 154(b) by 140 days.

(21) Appl. No.: 13/687,909

(22) Filed: Nov. 28, 2012

(51) Int. Cl.
*A63B 21/062* (2006.01)
*A63B 21/00* (2006.01)
*A63B 21/06* (2006.01)

(52) U.S. Cl.
CPC ..... *A63B 21/0618* (2013.01)
USPC ..... 482/100; 482/98; 482/99

(58) Field of Classification Search
CPC ..... A63B 21/154; A63B 21/156
USPC ..... 482/98–103
See application file for complete search history.

(56) References Cited

U.S. PATENT DOCUMENTS

| | | | | |
|---|---|---|---|---|
| 4,211,403 | A | 7/1980 | Coffaro et al. | |
| 4,880,227 | A * | 11/1989 | Sowell | 482/102 |
| 5,181,895 | A * | 1/1993 | Larson et al. | 482/93 |
| 5,820,519 | A | 10/1998 | Slenker | |
| 6,217,493 | B1 * | 4/2001 | Spletzer | 482/103 |
| 6,228,004 | B1 | 5/2001 | Steinbach et al. | |
| 6,592,502 | B1 | 7/2003 | Phillips | |
| 7,014,601 | B2 | 3/2006 | Savage et al. | |
| D531,237 | S | 10/2006 | Giger et al. | |
| 2007/0042878 | A1 * | 2/2007 | Lundquist et al. | 482/99 |
| 2010/0285935 | A1 * | 11/2010 | Barnett | 482/99 |

FOREIGN PATENT DOCUMENTS

| | | | | |
|---|---|---|---|---|
| GB | 2186806 A * | 8/1987 | | A63B 21/06 |

* cited by examiner

*Primary Examiner* — Stephen Crow
*Assistant Examiner* — Joshua Lee

(57) ABSTRACT

An exercise bench allows a user to practice both legs together while each one has an independent weight load for the user's preference. The exercise bench has a pivotably adjustable back support, seat panel. The bench is disposed between a base frame and top frame with three connection columns. The first two columns have weight support displaced at the lower end and an opening on the top end for a pulley for each column. The top frame also supports an adjustable pulley support panel with two additional pulleys disposed on two opposite sides of the panel. Two independent cables connect weight through the pulley to the user's foot. The user can apply the same or different weight load to each leg and thus can practice accordingly.

8 Claims, 4 Drawing Sheets

(ISO View)

(Top View)

(Side View)

(Back View)

(Front View)

(In-use View)

EXERCISE BENCH SYSTEM

FIELD OF THE INVENTION

The invention is related to an exercise bench for a user to build up leg muscles.

BACKGROUND OF THE INVENTION

There are many kinds of exercise benches on the market for a user to build up leg muscles. A majority of them are designed for a joint weight load system for both legs. There is a need for an exercise bench that users can practice both legs together while each one has an independent weight load for the user's preference.

Any feature or combination of features described herein is included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features an exercise bench which allows users to practice both legs together while each one has an independent weight load for the user's preference.

The exercise bench has a pivotably adjustable back support, seat panel. The bench is disposed between a base frame and top frame with three connection columns. The first two columns have a weight support displaced at the lower end and an opening on the top end for a pulley for each column. The top frame also support an adjustable pulley support panel with two additional pulleys disposed on two opposite sides of the panel. Two independent cables connect weights through the pulley to the user's foot. The user can apply the same or different weight load to each leg and thus can practice accordingly.

DESCRIPTION OF PREFERRED EMBODIMENTS

Figure 1:
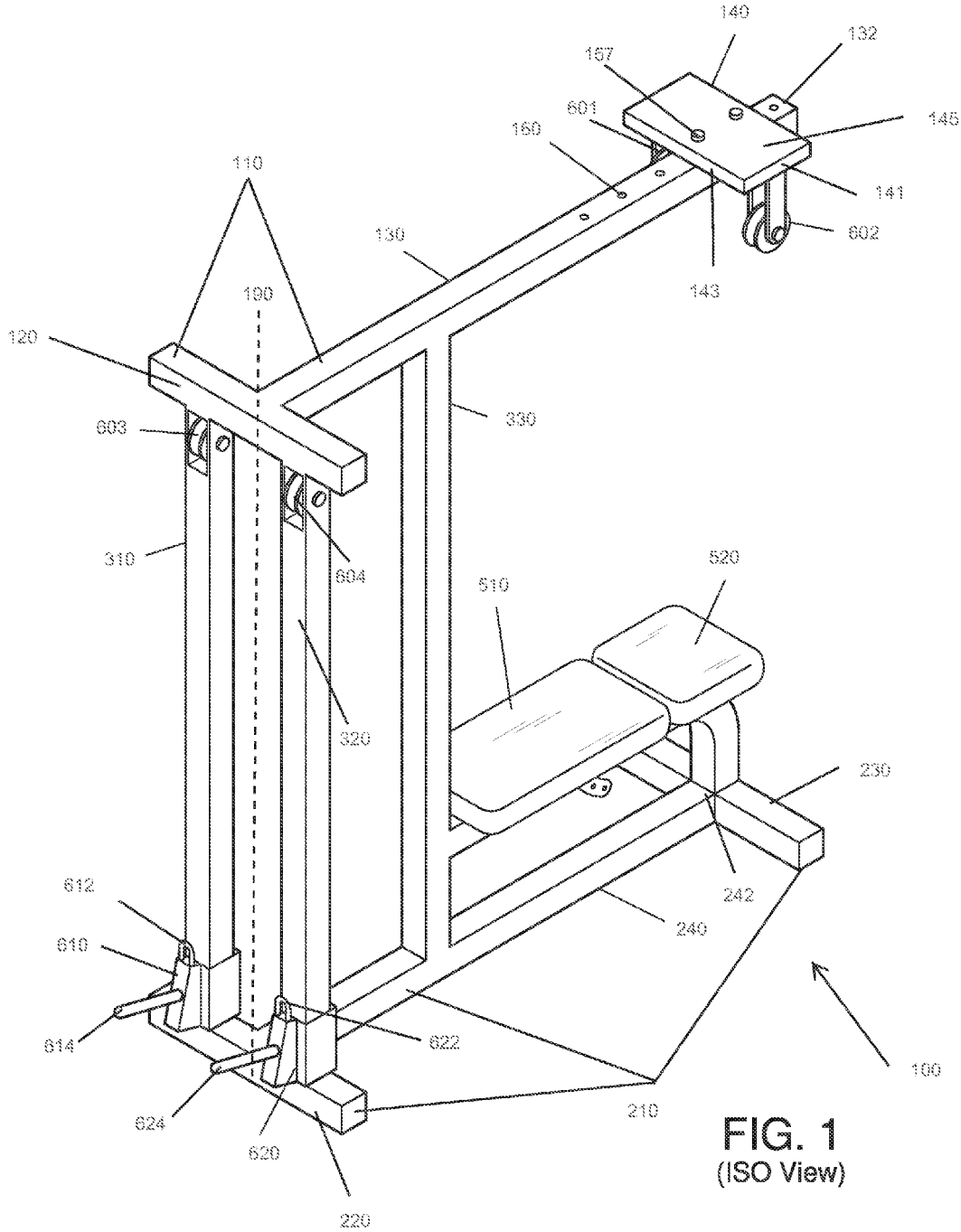
FIG. 1 shows an isometric view of the device.
Figure 2:
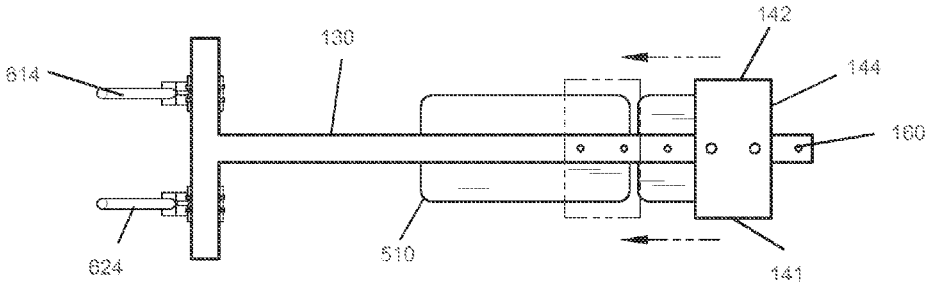
FIG. 2 shows a top view of the device.
Figure 3:
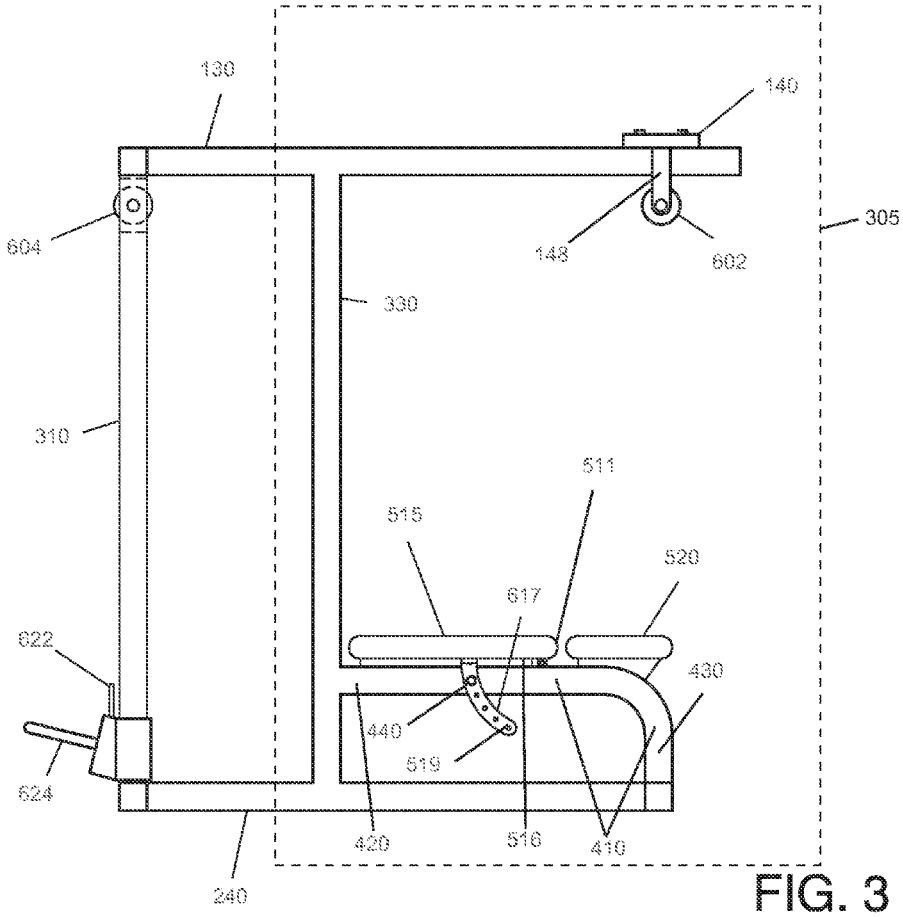
FIG. 3 shows a side view of the device.
Figure 4:
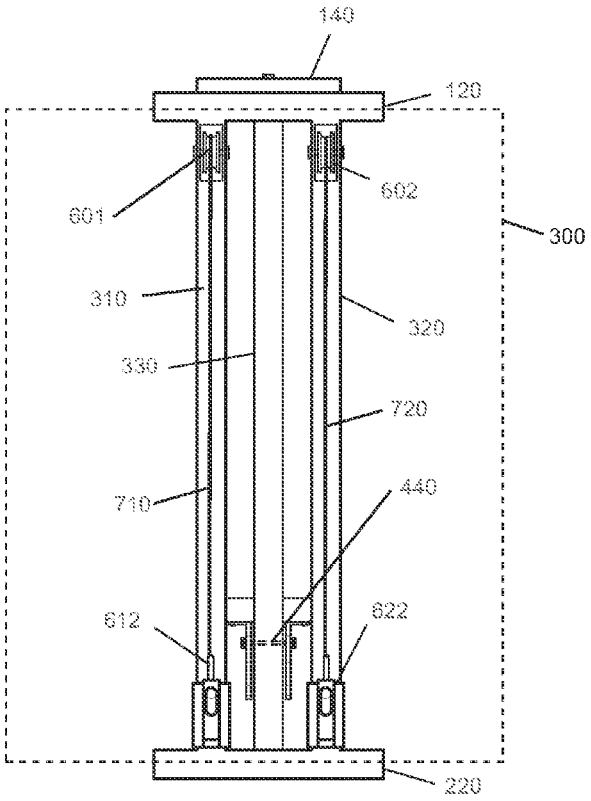
FIG. 4 shows a back view of the device.
Figure 5:
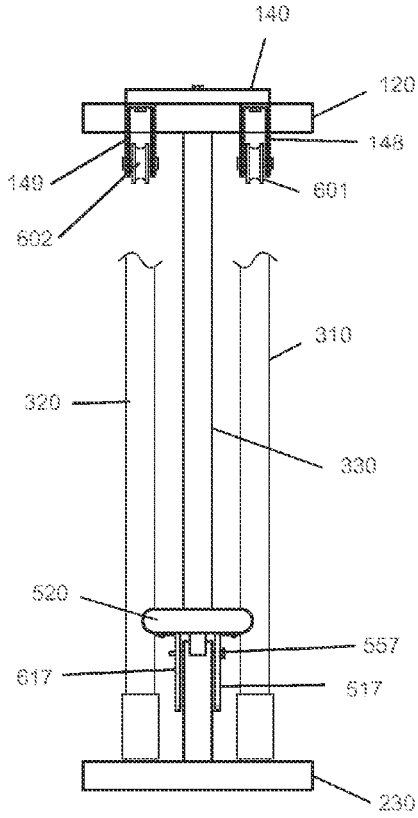
FIG. 5 shows a front view of the device.
Figure 6:
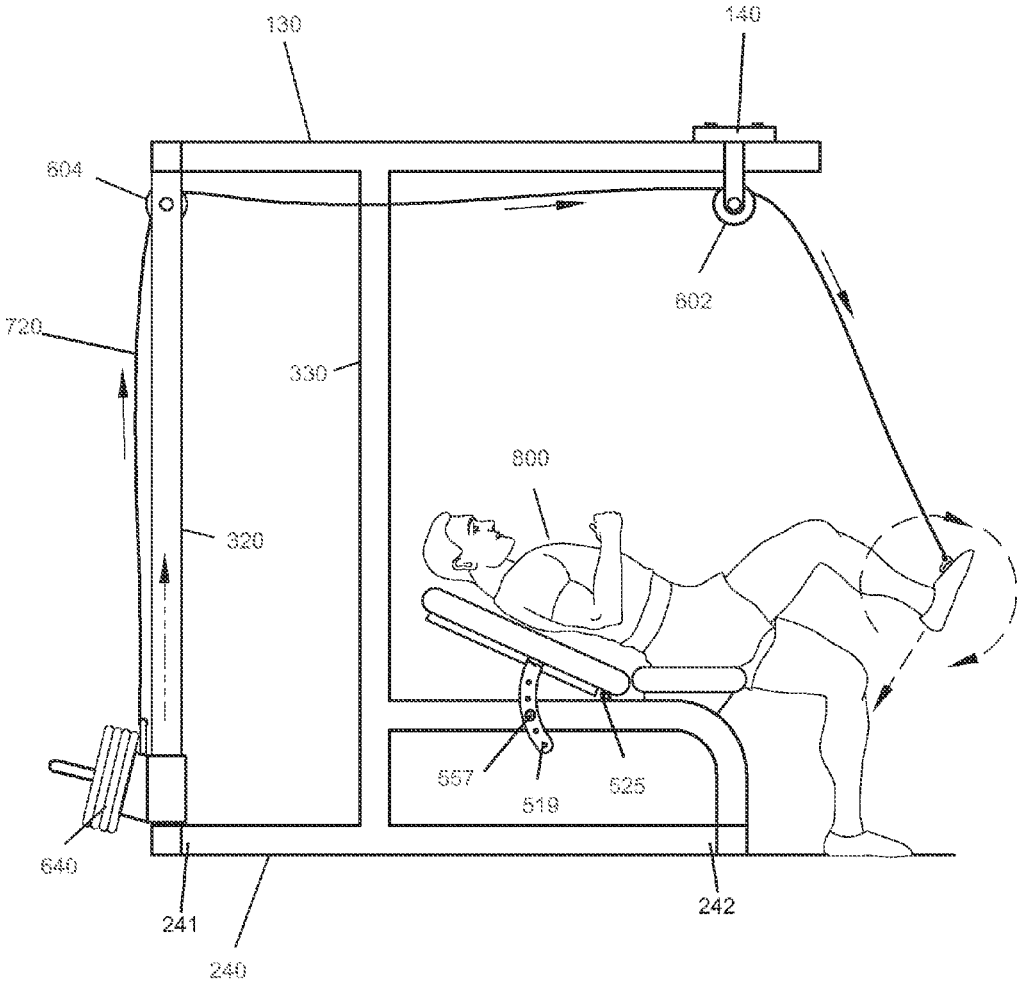
FIG. 6 shows an in-use view of the device.

Referring now to FIGS. 1-5, the present invention features an exercise bench system which allows users to practice both legs together while each one has an independent weight load for the user's preference. The exercise bench system (100) comprises a T-shape top frame (110), a base frame (210), three columns (310, 320 and 330), a pulley support panel (140), two weights support (610 and 620), two cables (710 and 720, with one shown in FIGs).

The T-shape top frame (110) comprises a first arm (120) and a second arm (130), wherein the second arm has a distal end (131) and proximal end (132) with the said proximal end perpendicularly connected to the center of the first arm (120), wherein a plurality of uniformly distributed adjustment holes (160) aligned in a single line disposed on the second arm (130) near the proximal end (132).

The pulley support panel (140) is disposed on the top of the second arm (130) near the proximal end (132), wherein the panel has a top side (145), a bottom side (146), a first edge (141), a second edge (142), a third edge (143) and a fourth edge (144), wherein a first hole (147*a*) and second hole (147*b*) are disposed on the top side with the distance between the said first and second holes the same as the distance between the said adjustment holes (160) such that the position of the said panel (140) is adjustable by aligning the holes (147) to various adjustment holes (160), wherein the pulley support panel (140) is secured by two lock means (157), wherein a first downwardly turned overhang (148) and a second downwardly turned overhang (149) are connected to the bottom side (146) of said pulley support panel (140), wherein a first pulley (601) is connected to the proximal end of the first overhang (148) and a second pulley (602) is connected to the proximal end of the second overhang (149), wherein the first downwardly turned overhang (148) is aligned with the first edge (141) of the support panel (140) and the second downwardly turned overhang (149) is aligned with the second edge (142) of the support panel (140).

In some embodiments, the lock means (157) to tighten the said pulley support panel (140) to the said second arm (130) is a screwed bolt to connect the threads disposed inside the said connecting holes (160).

The exercise bench system (100) further comprises a base frame (210) on a base frame plane parallel to the top frame plane, wherein the base frame comprises a third arm (220), a fourth arm (230) and a connecting arm (240) with a first end (241) and an opposite end (242), wherein the first end (241) is perpendicularly connected to the center of the third arm (220) and the opposite end (242) is perpendicularly connected to the center of the fourth arm (230), wherein the said third arm (220) of the base frame (210) and the first arm (120) of the top frame are both on a first vertical plane (300), wherein the first vertical plane is perpendicular to the base frame plane.

Three columns connect the top frame (110) and base (210) with all three columns perpendicular to both the top frame plane and base frame plane, where the first column (310) and second column (320) join said first arm (120) and said third arm (220), the first column (310) and second (320) are disposed symmetrically on the opposite sides to the center line (190) which connects the middle points of said first arm (120) and said second arm (220), wherein the third column (330) joins the said second arm (130) and said connecting arm (240), wherein the third column is closer to said third arm (220) than the said fourth arm (230), wherein the first column (310) has an opening on the top end where a third pulley (603) is disposed, wherein the second column (320) has an opening on the top end where a fourth pulley (604) is disposed.

The exercise bench system (100) comprises an L-shape frame (410) with a fifth arms (420) and a sixth arm (430), wherein the L-shape frame (410), the said second arm (130) and said connecting arm (240) are all on a second vertical plane (305), wherein the sixth arm (430) is perpendicularly connected to the center of the said fourth arm (230) and the fifth arm (420) is perpendicularly connected to the third column (330), wherein a third hole (440) is disposed on the fifth arm (420).

The exercise bench system (100) includes a back support (510) and seat panel (520), wherein the back support and the seat panel are adjacent with the back support, wherein both the back support and the seat panel are supported by the said fifth arm (420), wherein the seat is fixedly attached on the fifth arm (420), wherein the back support (510) has a first edge (511), a second edge (512), a third edge (513), a fourth edge (514), a top side (515) and bottom side (516), wherein the first edge (511) is adjacent to the said seat panel (520) and farther away from the column (330), wherein the said back support is pivotably attached to the said fifth arm (420) via a hinge (525), wherein a first flange (517) and second flange (617) are attached to the said bottom side (516), wherein the first flange (517) and second flange (617) are adjacent to the said fifth arm (420) and on the opposite side of the said fifth arm (420), wherein the flange (517) and second flange (617) have a plurality of holes (519), wherein the pivot angle of the said back support (510) is adjustable by aligning the desired flange hole (519) with the said third hole (440) on the fifth arm (420), wherein the flange is secured to the third hole (440) via a secure means (557).

In some embodiments, the secure means (557) to tighten the said first and second flanges (519 and 619) is a bolt and nut set, wherein the bolt passes through the aligned holes (519) of the first flange, second flange and the third hole (440) disposed on the fifth arm (420).

A first weight support (610) is slidably connected to the first column (310) such that the first weight support (610) is slidable along the first column (310). A second weight support (620) is slidably connected to the second column (320) such that the second weight support (620) is slidable along the second column (320), wherein the first weight support has a first hook (612) disposed on the top of the first support (610) and a first elongated handle (614) disposed on a first side edge (616) of the first weight support (610), wherein the said first side edge (616) is the edge opposing the direction of the said connecting arm (240) of the base frame (210), wherein the second weight support (620) has a second hook (622) disposed on the top of the said second support (620) and a second elongated handle (624) disposed on a second side edge (626) of the second weight support (620), wherein the said second side edge (626) is the edge opposing the direction of the said connecting arm (240) of the base frame (210), wherein a plurality of weight plates (640) is hanging on the said first handle (614) and second handle (624).

The exercise bench system (100) includes a first cable (710) and second cable (720) for the connection between the user's legs and the weight. The first cable (710) has a first end (711) and second end (712) with the first end (711) attached to the said first hook (612). The second cable (720) has a first end (721) and second end (722) with the first end (721) attached to the said second hook (622); wherein the first cable (710) extends through the first pulley (601) and the third pulley (603), wherein the second cable (720) extends through the second pulley (602) and the fourth pulley (604).

When a user (800) lays on the back support (510) and seat panel (520), he/she can adjust the back support pivot angle according to his/her desires. The user then secures his/her feet to the second ends of the first cable (710) and/or second end of the second cable (720) via an attaching means (657), wherein the user can pull his/her leg(s) to lift the weight hanging on the weight support (610) and/or the weight support (620).

In some embodiments, the user secure his/her left foot to the second end of the said first cable via an attaching means (657) and secure his/her right foot to the second end of the second cable via an attaching means (657). In some embodiments, the user secures his/her left foot to both the second end of the said first cable and the second end of the second cable via an attaching means (657). In some embodiments, the user secures his/her right foot to both the second end of the said first cable and the second end of the second cable via an attaching means (657).

In some embodiments, the user secures his/her feet to the second end of the cable(s) via an attaching means (657). In some embodiments, the secure means is a stirrup wherein the user put his/her feet with or without shoes. The stirrup is made of hard materials such as metal or soft materials such as fabrics. In some embodiments, the secure means is a clip, wherein the user connects the clip to his/her shoe ties and a loop disposed on the second end of the second end(s) of the first cable and/or second cable.

In some embodiments, a plurality of weight plates are loaded on the first weight support and the same plurality of weight plates are loaded on the second weight support. In some embodiments, a plurality of weight plates are loaded on the first weight support and a different plurality of weight plates are loaded on the second weight support. This is particularly helpful for those persons with different weight preference for their left and right legs, for example, for people who had previous injuries to one of their legs or people who want to strengthen one leg purposely. Hence, allowing different loads for the left and right legs is more advantageous than an exercise bench that has only the option of a joint weight load for both legs.

In some embodiment, the weight plate is ranging from 1 pound to 10 pounds each. In some embodiment, the weight plate is ranging from 1 pound to 20 pounds each. Alternatively, the weight plate is ranging from 1 kilogram to 5 kilograms. As used herein, the term "about" refers to plus or minus 10% of the referenced number.

The disclosures of the following U.S. Patents are incorporated in their entirety by reference herein: U.S. Pat. No. 5,820,519, U.S. Pat. No. 6,228,004, U.S. Pat. No. 6,592,502, U.S. Pat. No. 7,014,601, U.S. Design Pat. No. 531,237 and U.S. Pat. No. 4,211,403.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An exercise bench system for budding a user's muscle strength for each leg independently, the system (100) comprising:

(a) a T-shape top frame (110) with a first arm (20) and a second arm (130), wherein the second arm has a distal end (131) and proximal end (132) with the said proximal end perpendicularly connected to the center of the first arm (120), wherein a plurality of uniformly distributed adjustment holes (160) aligned in a single line disposed on the second arm (130) near the proximal end (132), wherein the first arm (120) and the second arm (130) are both on a top frame plane;

(b) a pulley support panel (140) disposed on the top of the second arm (130) near the proximal end (132), wherein the panel has a top side (145), a bottom side (146), a first edge (141), a second edge (142), a third edge (143) and a fourth edge (144), wherein a first hole (147*a*) and second hole (147*b*) are disposed on the top side with the distance between the said first and second holes the same as the distance between the said adjustment holes (160) such that the position of the said panel (140) is adjustable by aligning the holes (147) to various adjustment holes (160), wherein the pulley support panel (140) is secured by two lock means (157), wherein a first downwardly turned overhang (148) and a second downwardly turned overhang (149) are connected to the bottom side (146) of said pulley support panel (140), wherein a first pulley (601) is connected to the proximal end of the first overhang (148) and a second pulley (602) is connected to the proximal end of the second overhang (149), wherein the first downwardly turned overhang (148) is aligned with the first edge (141) of the support panel (140) and the second downwardly turned overhang (149) is aligned with the second edge (142) of the support panel (140);

(c) a base frame (210) on a base frame plane parallel to the top frame plane, wherein the base frame comprises a third arm (220), a fourth arm (230) and a connecting arm (240) with a first end (241) and an opposite end (242), wherein the first end (241) is perpendicularly connected to the center of the third arm (220) and the opposite end (242) is perpendicularly connected to the center of the fourth arm (230), wherein the said third arm (220) of the base frame (210) and the first arm (120) of the top frame are both on a vertical plane (300), wherein the vertical plane is perpendicular to the base frame plane;

(d) three columns connecting the top frame (110) and base (210) with all three columns perpendicular to both the top frame plane and the base frame plane, where the first column (310) and second column (320) join said first arm (120) and said third arm (220), wherein the first column (310) and second (320) are disposed symmetrically on the opposite sides to the center line (190) which connects the middle points of said first arm (120) and said second arm (220), wherein the third column (330) joins the said second arm (130) and said connecting arm (240), wherein the third column is closer to said third arm (220) than the said fourth arm (230), wherein the first column (310) has an opening on the top end where a third pulley (603) disposed, wherein the second column (320) has an opening on the top end where a fourth pulley (604) disposed;

(e) an L-shape frame 410 with a fifth arm (420) and a sixth arm (430), wherein the L-shape frame (410), the said second arm (130) and said connecting arm (240) are all on a second vertical plane (305), wherein the sixth arm (430) is perpendicularly connected to the center of the said fourth arm (230) and the fifth arm (420) is perpendicularly connected to the third column (330), wherein a third hole (440) is disposed on the fifth arm (420);

(f) a back support (510) and seat panel (520), wherein the back support and the seat panel are adjacent with the back support, wherein both the back support and the seat panel are supported by the said fifth arm (420), wherein the seat is fixedly attached on the fifth arm (420), wherein the back support (510) has a first edge (511), a second edge (512), a third edge (513), a fourth edge (514), a top side (515) and bottom side (516), wherein the first edge (511) is adjacent to the said seat panel (520) and farther away from the column (330), wherein the said back support is pivotably attached to the said fifth arm (420) via a hinge (525), wherein a first flange (517) and second flange (617) are attached to the said bottom side (516), wherein the first flange (517) and second flange (617) are adjacent to the said fifth arm (420) and on the opposite side of the said fifth arm (420), wherein the flange (517) and second flange (617) have a plurality of holes (519), wherein the pivot angle of the said back support (510) is adjustable by aligning the desired flange hole (519) with the said third hole (440) on the fifth arm (420), wherein the flange is secured to the third hole (440) via a secure means (557);

(g) a first weight support (610) and second weight support (620), wherein the first weight support (610) is slidably connected to the first column (310) such that the first weight support (610) is slidable along the first column (310), wherein the second weight support (620) is slidably connected to the second column (320) such that the second weight support (620) is slidable along the second column (320), wherein the first weight support has a first hook (612) disposed on the top of the first support (610) and a first elongated handle (614) disposed on a first side edge (616) of the first weight support (610), wherein the said first side edge (616) is the edge opposing the direction of the said connecting arm (240) of the base frame (210), wherein the second weight support (620) has a second hook (622) disposed on the top of the said second support (620) and a second elongated handle handle (624) disposed on a second side edge (626) of the second weight support (620), wherein the said second side edge (626) is the edge opposing the direction of the said connecting arm (240) of the base frame (210), wherein a plurality of weight plates (640) are hanging on the said first handle (614) and the second handle (624);

(h) a first cable (710) and second cable (720), wherein the first cable (710) has a first end (711) and second end (712) with the first end (711) attached to the said first hook (612), wherein the second cable (720) has a first end (721) and second end (722) with the first end (721) attached to the said second hook (622); wherein the first cable (710) extends through the first pulley (601) and the third pulley (603), wherein the second cable (720) extends through the second pulley (602) and the fourth pulley (604); and wherein the user secures his/her left foot to the second end of the said first cable via an attaching means (657) and secures his/her right foot to the second end of the second cable via an attaching means (657), wherein the user pulls his/her legs to lift the weight support (610) and the weight support (620).

2. The system of claim 1, wherein a plurality of weight plates are loaded on the first weight support and a different plurality of weight plates are loaded on the second weight support.

3. The system of claim 1, wherein a plurality of weight plates are loaded on the first weight support and the same plurality of weight plates are loaded on the second weight support.

4. The system of claim 1, wherein the secure means is a stirrup wherein the user puts his/her feet with or without shoes.

5. The system of claim 4, wherein the stirrup is made of hard materials such as metal or soft materials such as fabrics.

6. The system of claim 1, wherein the secure means is a clip, wherein the user connects the clip to his/her shoe ties and a loop disposed on the second end of the second end(s) of the first cable and/or second cable.

7. The system of claim 1, wherein the lock means (157) to tighten the said pulley support panel (140) to the said second arm (130) is a screwed bolt connecting threads disposed inside the said connecting holes (160).

8. The system of claim 1, wherein the secure means (557) to tighten the said first and second flanges (519 and 619) is a bolt and nut set, wherein the bolt passes through the aligned holes (519) of the first flange, second flange and the third hole (440) disposed on the fifth arm (420), then tightened by a nut.

* * * * *